US009451824B1

(12) United States Patent
Lee

(10) Patent No.: US 9,451,824 B1
(45) Date of Patent: Sep. 27, 2016

(54) COLLAPSIBLE TELEVISION SUPPORT ASSEMBLY WITH DUAL SUPPORT SHAFTS AND SEPARABLE BUCKLE HINGES

(71) Applicant: Harry Kai Lee, Pomona, CA (US)

(72) Inventor: Harry Kai Lee, Pomona, CA (US)

( * ) Notice: Subject to any disclaimer, the term of this patent is extended or adjusted under 35 U.S.C. 154(b) by 0 days.

(21) Appl. No.: 14/712,428

(22) Filed: May 14, 2015

(51) Int. Cl.

| | |
|---|---|
| ***A47B 81/06*** | (2006.01) |
| ***E05D 7/10*** | (2006.01) |
| ***E05D 3/02*** | (2006.01) |
| ***A47B 3/00*** | (2006.01) |

(52) U.S. Cl.
CPC ..... *A47B 81/06* (2013.01); *A47B 3/002* (2013.01); *E05D 3/02* (2013.01); *E05D 7/10* (2013.01)

(58) Field of Classification Search
CPC .. A47B 43/00; A47B 43/04; A47B 47/0083; A47B 3/0803; A47B 3/002; A47B 3/06; A47B 3/00; A47B 81/06; E05D 7/10; E05D 3/02
See application file for complete search history.

(56) References Cited

U.S. PATENT DOCUMENTS

| | | | | |
|---|---|---|---|---|
| 7,337,732 | B2 * | 3/2008 | Becker | A47B 43/00 108/115 |
| 7,913,863 | B2 * | 3/2011 | Lin | A47B 81/06 211/186 |
| 8,015,930 | B2 * | 9/2011 | Huang | A47B 43/00 108/115 |
| 8,015,931 | B2 * | 9/2011 | Lin | A47B 43/00 108/115 |
| 8,136,462 | B2 * | 3/2012 | Lin | A47B 43/00 108/193 |
| 8,333,444 | B1 * | 12/2012 | Chang | A47B 43/00 312/258 |
| 8,381,922 | B2 * | 2/2013 | Chung | A47B 43/00 108/193 |
| 2004/0046486 | A1 * | 3/2004 | Wicha | A47B 47/04 312/7.2 |
| 2006/0054754 | A1 * | 3/2006 | Liberman | A47B 81/06 248/172 |
| 2007/0215012 | A1 * | 9/2007 | Fridley | A47B 81/062 108/50.01 |
| 2011/0011816 | A1 * | 1/2011 | Marietta | A47B 43/00 211/149 |
| 2012/0007484 | A1 * | 1/2012 | Tsai | A47B 81/064 312/262 |

* cited by examiner

*Primary Examiner* — Hanh V Tran
(74) *Attorney, Agent, or Firm* — Songfong T. Wang; Yang & Wang, P.C.

(57) ABSTRACT

A television support assembly that provides enhanced lateral stability and hinges that pivot up to 90° and separate for facilitated collapsibility and assemblage. The assembly provides elongated arms, legs, connecting bars, and a rear frame that hingedly interconnect through separable buckle hinges and simple hinges to easily move between an expanded position and a collapsed position. The assembly also provides a pair of support shafts disposed transversely across the assembly for enhancing lateral stability in the expanded position. The rigidity of the support shafts enhances lateral structural integrity for supporting the weight of the television. An attachable vertical bracket can be detachably fastened to hold a flat screen television. Shelves can be installed between the arms for storage or additional entertainment components. Doors and windows may also be added for functionality or aesthetics.

20 Claims, 10 Drawing Sheets

COLLAPSIBLE TELEVISION SUPPORT ASSEMBLY WITH DUAL SUPPORT SHAFTS AND SEPARABLE BUCKLE HINGES

FIELD OF THE INVENTION

The present invention relates generally to a television support assembly that provides enhanced lateral stability and hinges that pivot up to 90° and separate for facilitated collapsibility and assemblage. More so, a television support assembly provides elongated arms, legs, connecting bars, and a rear frame that hingedly interconnect through at least one separable buckle hinge and at least one simple hinge to easily move between an expanded position and a collapsed position, and also provides a pair of support shafts disposed transversely across the assembly for enhancing lateral stability in the expanded position.

BACKGROUND OF THE INVENTION

It is known that a television is a telecommunication medium used for transmitting moving images and sound. The television can transmit images that are monochrome, in color, or in three dimensions. Generally, one type of television—a flat screen television—is lighter and thinner than traditional television sets and video displays that use cathode ray tubes. However, the flat screen television does not have a wide base to rest on, and thus, requires an external support for adjustable positioning and viewing.

Various brackets, mounts, and tables exist for flat screen televisions. One such support is a Flat Display Mounting Interface (FDMI). The FDMI is a family of standards defined by the Video Electronics Standards Association for mounting flat panel monitors, TVs, and other displays to stands or wall mounts. It is generally implemented on most modern flat-panel monitors and televisions.

Additionally, inexpensive stands for the flat screen television are available. However, often these stands, which require user assembly, often are not well designed with the thought of television dimensions and weight in mind. For example, the stands are often constructed of lightweight, inexpensive materials that are not conducive to stability. Furthermore, venting of the component heat is often poor, and may result in obvious holes and vents which detract from the aesthetic appeal of these stands. Additionally management of the considerable number of cables is typically an afterthought.

Better quality stands have improved appearance but may still not be carefully designed for home entertainment systems. For example fixed shelves do not take into account component size which often requires varying shelf clearance. Furthermore these stands can take a considerable amount of time to assemble. Even assembly for store display of the stand can be an issue as employee labor rates are high and time is often of the essence during new store openings and busy selling seasons. Additionally, assembly of the stands may require many assembly steps and proper orientation of parts.

Often, television stands, and supportive furniture structures in general, are shipped in a fully-assembled condition from a manufacturer to a retailer and then carried off by an end user to a home or office. Consequently, the television stands is generally bulky, cumbersome and difficult to transport in a space-efficient manner. That is to say, a fully-assembled television stands consumes relatively large shipping space during transport to a retailer. Similarly, the end user may need to have available a specially-sized vehicle should he wish to carry the television stand to the home or office. The inefficient shipment of the television stand between the manufacturer and end user often results in inconvenience as well as significantly higher transportation costs which are commonly passed through to the purchaser.

Other proposals have involved folding television stands. The problem with these devices is that they do not provide a stable configuration while supporting the weight of the television, nor are the hinges for folding the television stand sufficiently detachable and pivotal.

Thus, an unaddressed need exists in the industry to address the aforementioned deficiencies and inadequacies. Even though the above cited methods for flat screen television stands meets some of the needs of the market, a collapsible television support assembly with dual support shafts and separable buckle hinges is still desired.

SUMMARY OF THE INVENTION

The present invention is directed to a television support assembly that provides enhanced lateral stability and hinges that pivot up to 90° and separate for facilitated collapsibility and assembly. The television support assembly includes elongated arms, legs, connecting bars, and a rear frame that hingedly interconnect through at least one separable buckle hinge and at least one simple hinge to easily move between an expanded position and a collapsed position, and also provides a pair of support shafts disposed transversely across the assembly for enhancing lateral stability in the expanded position.

In some embodiments, the assembly may include a folding entertainment table that can be assembled and connectible with minimal tools or skill set. The assembly includes hinged arms, legs, and connecting bars that utilize separable buckle hinges to fold, expand, and detach for configurative manipulations between an expanded position for supporting the television, and a collapsed position for stowage and portability. A pair of support shafts transverse the assembly from a front region to a rear region. The rigidity of the support shafts enhances lateral structural integrity for supporting the television.

In some embodiments, an attachable vertical bracket can be detachably fastened to a rear frame to hold a flat screen type television. There are means to install shelves between the arms for storage or additional entertainment components. In one embodiment, doors and windows may also be added for functionality or aesthetics.

In some embodiments, the assembly may include at least one separable buckle hinge. The at least one separable buckle hinge enables hinged and detachable connections. Specifically, the separable buckle hinge is used to fasten, connect, and pivot multiple sections of the assembly relative to each other. The separable buckle hinge segments into two sections to enable separation and pivoting by the assembly.

The separable buckle hinge comprises a lip and a latching member. In one exemplary embodiment, the lip is attached to the middle arm, and the latching member is fastened to the front shaft end. The latching member pivotally fastens and detaches from the lip in a secure but adjustable manner. The latching member comprises a mounting panel, a lever, and a catch. The lever of the latching member is configured to pivot on a fulcrum to pivotally move the catch and engage the lip. In this manner, the lip catches and holds the latching member for detachable fastening. In one embodiment, the separable buckle hinge pivots up to 90°.

In operation, the lever is configured to pivot on the fulcrum selectively, to and from the lip, such that the catch engages and disengages from the lip. Once the catch clasps onto the generally protruding lip, a force is applied to the lever away from the lip to forcibly clamp the respective sections of the assembly together. The direction of the lever may then be reversed to disengage the catch from the lip, and thereby enable separation of the respective sections of the assembly.

The assembly also utilizes at least one simple hinge to enable hinged connections between sections of the assembly. However, unlike the separable buckle hinge, the simple hinge does not separate. The simple hinge comprises a first hinge side that pivotally joins a second hinge side. In one embodiment, the simple hinge pivots up to 90°.

In some embodiments, the assembly may include an upper arm. The upper arm is defined by a pair of upper ends. The assembly further includes a middle arm. The middle arm is defined by a pair of middle ends. The assembly further includes a lower arm. The lower arm is defined by a pair of lower ends. The upper arm, the middle arm, and the lower arm are disposed in a generally horizontal, spaced-apart relationship. In some embodiments, the assembly may include a pair of legs. Each leg attaches in a generally perpendicular disposition to a respective end of the upper arm, the middle arm, and the lower arm.

In some embodiments, the assembly may include a pair of first connecting bars. The pair of first connecting bars are disposed in a generally parallel, spaced apart relationship. The pair of first connecting bars are defined by a first front end and a first rear end. The first front end is pivotally carried by the upper arm and the lower arm. The pair of first connecting bars are coupled to the upper arm and the lower arm about the simple hinge.

In some embodiments, the assembly may include a pair of second connecting bars. The pair of second connecting bars are disposed in a generally parallel, spaced apart relationship. The pair of second connecting bars are defined by a second front end and a second rear end. The second front end is pivotally carried by the upper arm and the lower arm. The pair of second connecting bars are coupled to the upper arm and the lower arm about the simple hinge.

In some embodiments, the assembly may include a generally rectangular frame. The frame is defined by an upper frame end, a lower frame end, a first frame end, and a second frame end. Each end joins together to form a substantially rectangular shape. The first frame end is pivotally carried by the pair of first connecting bars about the separable buckle hinge. In this manner, the frame may pivot up to 90°, and separate from the first connecting bars while moving to the collapsed position. The second frame end is pivotally carried by the pair of second connecting bars about the simple hinge. In this manner, the frame may pivot up to 90°, yet simple separation is not possible with the simple hinge.

The at least one separable buckle hinge and the at least one simple hinge enable the arms, legs, and connecting bars to hingedly collapse and expand. The separable buckle hinge further enables separation of the respective arms, legs, connecting bars, and frame ends.

In one exemplary configuration, the pair of first connecting bars are disposed to extend at an angle between the first leg and the first frame end while in an expanded position. Conversely, the pair of first connecting bars move coplanar to the upper arm, the middle arm, and the lower arm in the collapsed position. This forms a substantially flat configuration that is efficacious for stowage and portability of the assembly.

In another exemplary configuration, the pair of second connecting bars are disposed to extend at an angle between the second leg and the second frame end while in an expanded position. Conversely, the pair of second connecting bars move coplanar to the upper arm, the middle arm, and the lower arm while in the collapsed position. This forms a substantially flat configuration that is efficacious for stowage and portability of the assembly.

In another exemplary configuration, the frame is disposed in a coplanar, spaced-apart relationship with the upper arm, the middle arm, and the lower arm while in the expanded position. Conversely, the frame is disposed between the pair of first connecting bars and the upper arm, the middle arm, and the lower arm while in the collapsed position. This forms a substantially flat configuration that is efficacious for stowage and portability of the assembly.

The assembly may further include a pair of support shafts that extend transversely form a front region to a rear region of the assembly. The support shafts provide lateral stability to the assembly. The capacity to provide lateral stability is especially significant since the assembly supports generally heavy televisions and entertainment devices. The pair of support shafts are defined by a front shaft end and a rear shaft end. The support shafts are pivotally carried by the middle arm. The front shaft end is coupled to the middle arm about the separable buckle hinge. In other embodiments, the pair of support shafts are also pivotally carried by the first frame end and the second frame end. The rear shaft end couples to the first frame end and the second frame end about the simple hinge.

In some embodiments, the pair of support shafts extend between the middle arm and the frame while in the expanded position. This transverse crossing fills a space in the central region of the assembly, which restricts undesirable torqueing, bending, and warping of the legs, arms, connecting bars, and frame that make up the assembly. However, the pair of support shafts pivot towards the arms be pressed coplanar with the upper arm, the middle arm, and the lower arm in the collapsed position.

Thus, the assembly is specially configured so that the arms, legs, connecting bars, and frame ends are hingedly and detachably connected together so that they may be quickly assembled and also disassembled and returned to the collapsed position for further storage or shipment.

One objective of the present invention is to provide a foldable television structure that utilizes separable buckle hinges to fold, separate, and interconnect different sections of the assembly, such that configuration between a collapsed position and an expanded position is possible.

Another objective is to provide a pair of support shafts that extend transversely through the assembly to enhance overall lateral stability.

Another objective is to provide a greater level of portability for a television stand for moving and storage than non-foldable television stands.

Another objective is to provide an upright vertical bracket for fastening flat screen televisions.

Yet another objective is to enable fast collapsing for stowage without requiring tools.

Yet another objective is to attach shelves to the assembly for storage of television related items.

Yet another objective is to attach a vertical bracket to the rear frame for attachment of a flat screen television.

Yet another objective is to provide a cost effective television stand that is stable enough to support heavy televisions, yet also configurable to easily collapse for stowage.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 2A is a frontal view, FIG. 2B is a rear view, in accordance with an embodiment of the present invention;

FIG. 9A illustrates a fully operational expanded position, FIG. 9B illustrates a frame pivoting towards the first connecting bar, FIG. 9C illustrates the pair of support shafts pivoting coplanar towards the arms, and FIG. 9D illustrates the television support assembly in a fully collapsed position.

Like reference numerals refer to like parts throughout the various views of the drawings.

DETAILED DESCRIPTION OF THE INVENTION

Figure 1:
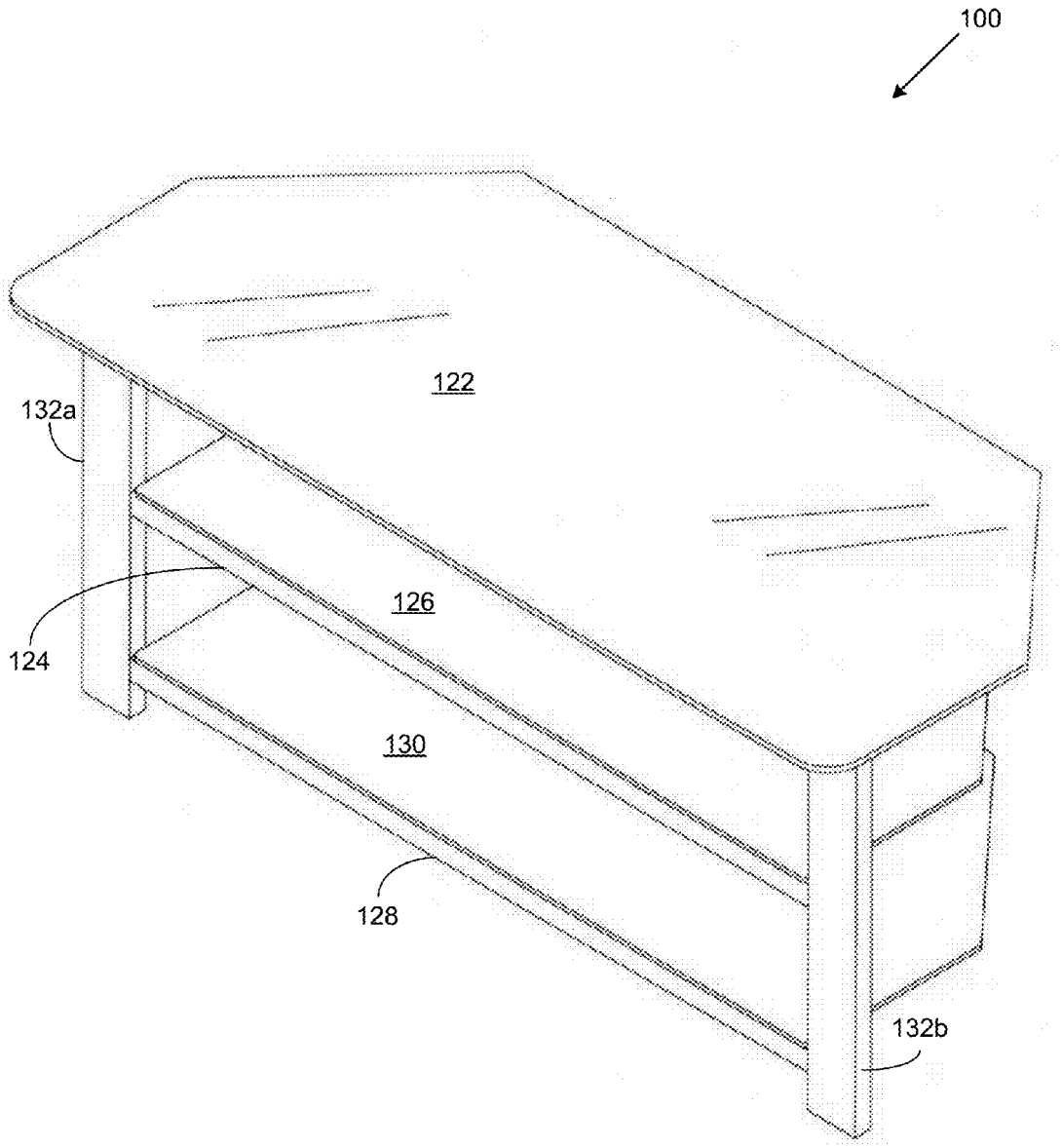
FIG. 1 illustrates a perspective view of an exemplary collapsible television support assembly with attached shelves, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-9D, a television support assembly 100 provides enhanced lateral stability while supporting the weight of a television, and includes at least one separable 102 buckle hinge between components that pivots up to 90° and separates for facilitated collapsibility and assemblage. The television support assembly 100 hereafter, "assembly 100", provides a rigid, multi-configurable support structure for supporting a television or other entertainment device, such as a flat screen television, a stereo, a computer, or a video system. The assembly 100 easily collapses for stowage, but also reversibly and easily expands for use without requiring tools or special skill. In some embodiments, the assembly 100 may include a folding entertainment table for supporting a flat screen television.

The assembly 100 utilizes variously disposed and sized elongated members that interconnect with hinges to construct the laterally stable and pivotally detachable configurations described below. In one possible embodiment, the assembly 100 may have a generally trapezoidal shape when viewed from above, and a wide base for supporting the weight of the television. Though, the assembly 100 may also take other shapes when viewed from above, such as, a rhombus, a cube, a pyramid, an oval, or a rectangle. Suitable materials for the assembly 100 may include, without limitation, wood, metal, fiberglass, rigid polymers, bamboo, and cardboard.

In one possible embodiment referenced in FIG. 1, the assembly 100 comprises elongated horizontal arms 120, 124, 128, vertical legs 132*a-b*, connecting bars 134*a-b*, 140*a-b* and a rear frame 146 that hingedly interconnect through at least one separable buckle hinge 102 and at least one simple hinge 114. The hinges 102, 114 enable facilitated pivotal movement between an expanded position and a collapsed position.

In some embodiments, the separable buckle hinge 102 may enables up to 90° of hinged movement between the components of the assembly 100. The separable buckle hinge 102 also enables easy separation between attached components. Similarly, the simple hinge 114 allows up to 90° of hinged movement between components of the assembly 100. However, the simple hinge 114 does not separate as does the separable buckle hinge 102.

Figure 2A:
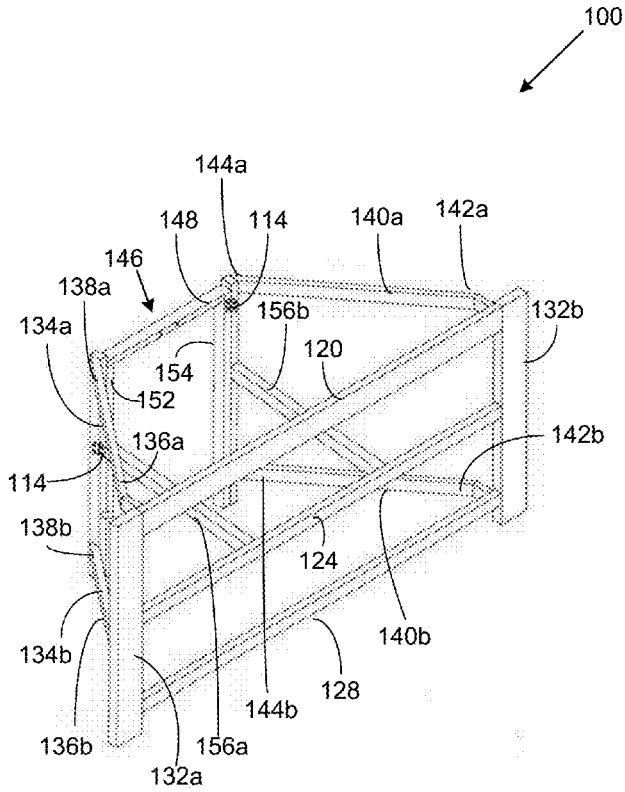
FIGS. 2A and 2B illustrate perspective views of the collapsible television support assembly, where

Turning now to FIG. 2A, the assembly 100 is generally stable because of a pair of support shafts 156*a-b* cross transversely through a space in the assembly 100. The position of the support shafts 156*a-b* in the center region of the assembly 100 enhances lateral stability while the assembly 100 is supporting the weight of the television in the expanded position. In one possible embodiment, the support shafts 156*a-b* include a pair of parallel, spaced-apart shafts with sufficient rigidity, such that the assembly 100 does not bend, torque, or warp when a heavy weight, such as a television, is placed on the assembly 100. The support shafts 156*a-b* orient from the front to the rear of the assembly 100.

Figure 2B:
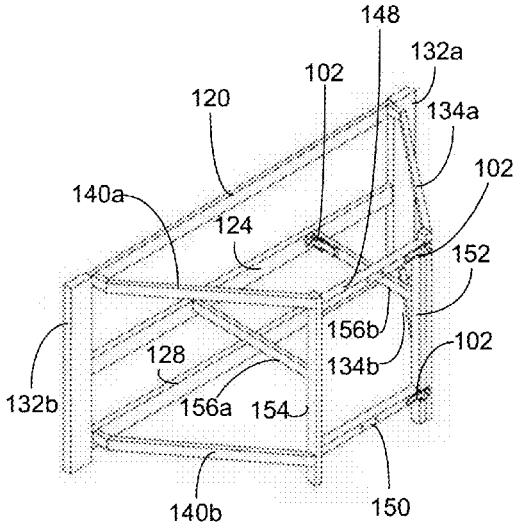

As illustrated in FIG. 2B, an attachable vertical bracket (not shown) can be detachably fastened to a rearwardly positioned frame 146 to hold a flat screen type television. The vertical bracket may include a plurality of fastening holes along a longitudinal axis to enable screws or other fasteners to pass through for fastening the television thereto. In one embodiment, installation means enable an upper shelf 122, a middle shelf 126, and a lower shelf 130 to position between the arms for storage or carrying additional entertainment components. In yet another embodiment, doors and windows may also be added to the assembly 100 for functionality or aesthetics.

Figure 3:
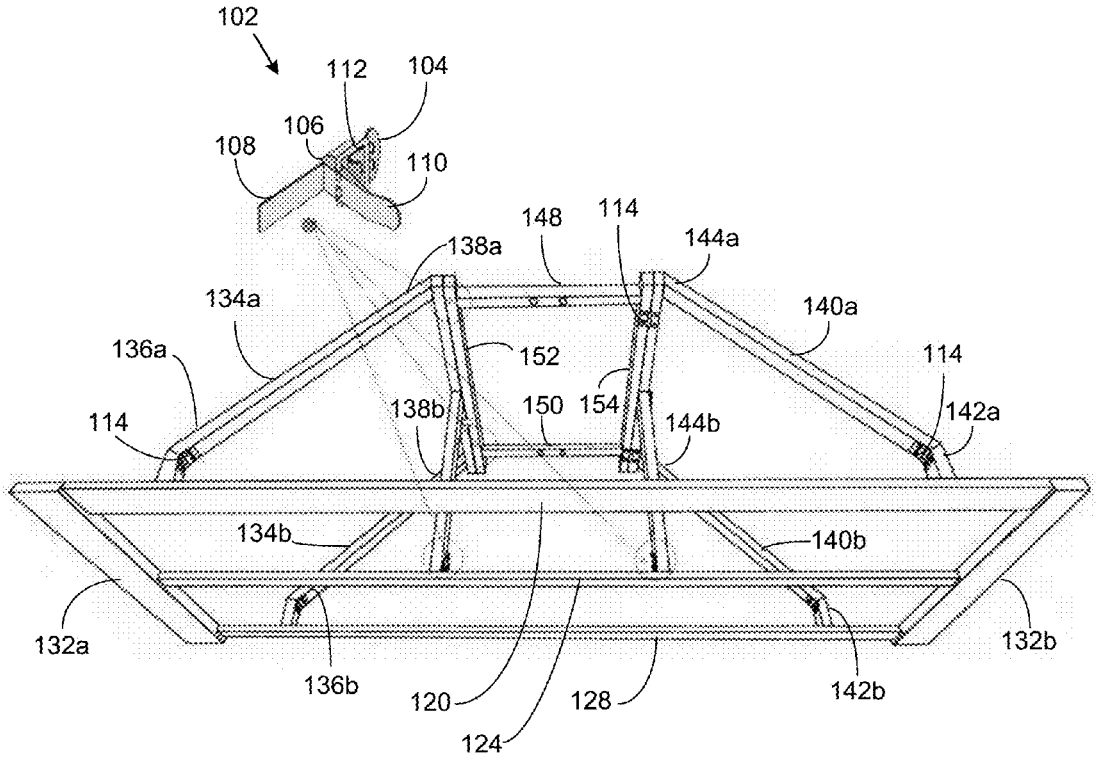
FIG. 3 illustrates perspective view of the collapsible television support assembly with a blow up view of an exemplary separable buckle hinge, in accordance with an embodiment of the present invention.

As referenced in FIG. 3, the assembly 100 may include at least one separable buckle hinge 102. The at least one separable buckle hinge 102 enables hinged and detachable connections between components of the assembly 100. Specifically, the separable buckle hinge 102 is used to fasten, connect, and pivot multiple sections of the assembly 100 relative to each other. The separable buckle hinge 102 segments into two sections: a lip 104 and a latching member 106. This separation works in conjunction with the pivoting capacity to facilitate the collapsing and expansion of the assembly 100, as needed. The latching member 106 portion of the separable buckle hinge 102 comprises a mounting panel 108, a lever 110, and a catch 112. The lever 110 pivotally moves the catch 112 to engage the lip 104, wherein the lip 104 and the latching member 106 detachably fasten.

Figure 4:
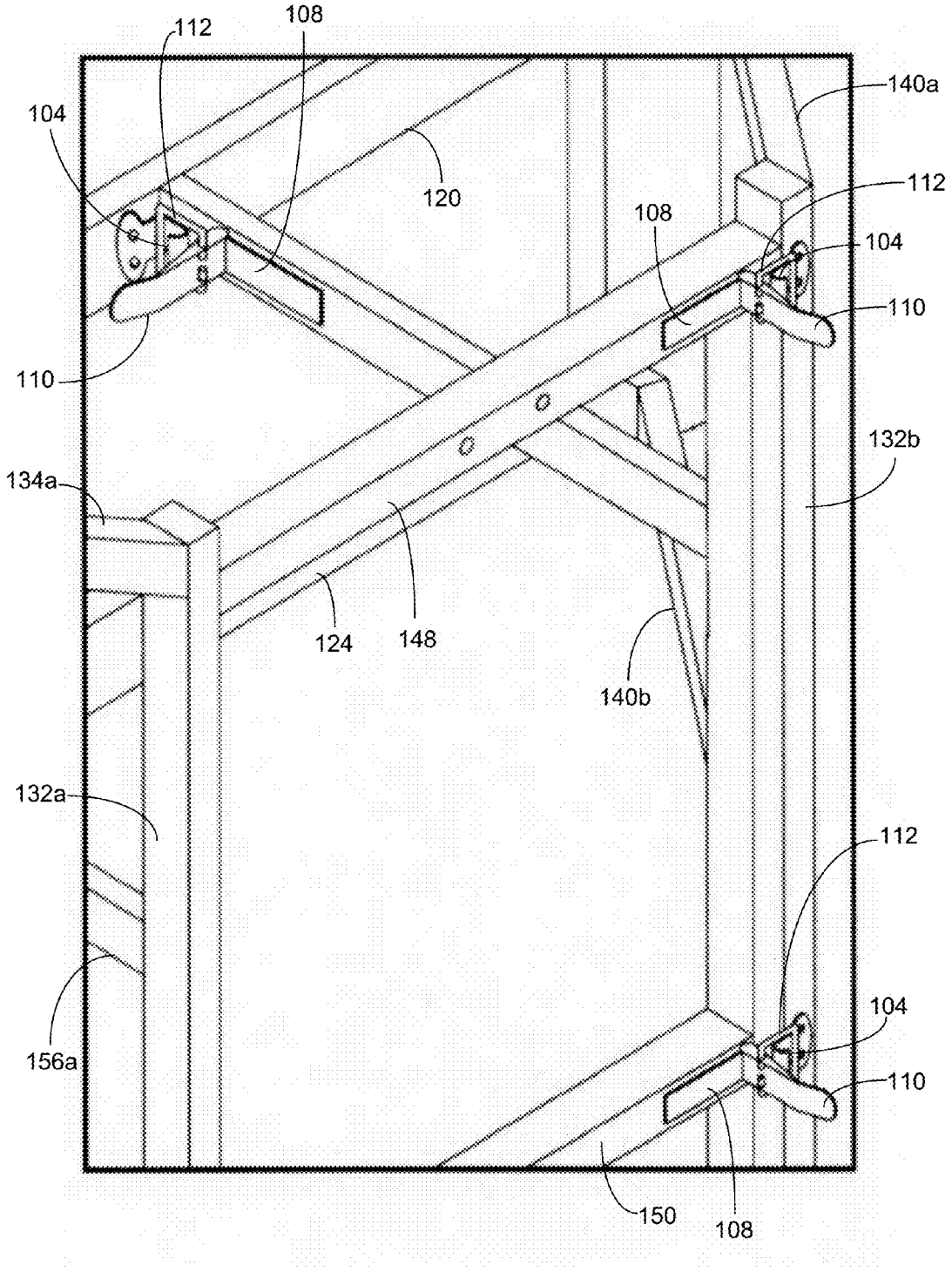
FIG. 4 illustrates a close-up view of the separable buckle hinge between a first frame end and a pair of first connecting bars, and between a front shaft end and a middle arm, in accordance with an embodiment of the present invention.

As shown in FIG. 4, the lip 104 portion of the separable buckle hinge 102 is configured to position on a circular plate that fastens to one section of the assembly 100 with fasteners, such as screws, bolts, adhesives, and the like. The latching member 106 also positions on an elongated mounting panel 108 that fastens to an adjacent, yet separate section of the assembly 100 by the same screws, bolts, and adhesives.

In one exemplary embodiment, the lip 104 is attached to the middle arm 124, and the latching member 106 is fastened to the front shaft end 158*a-b*. The latching member 106 pivotally fastens and detaches from the lip 104 in a secure but adjustable manner. The lever 110 of the latching member 106 is configured to pivot on a fulcrum to pivotally move the catch 112 and engage the lip 104. The fulcrum may be the mounting panel 108. In this manner, the lip 104 catches 112 and holds the latching member 106 for detachable fastening. In one embodiment, the separable buckle hinge 102 pivots up to 90°.

In operation, the lever 110 is configured to pivot on the fulcrum selectively, to and from the lip 104, such that the catch 112 engages and disengages from the lip 104. Once the catch 112 clasps onto the generally protruding lip 104, a force is applied to the lever 110 away from the lip 104 to forcibly clamp the respective sections of the assembly 100 together. The direction of the lever 110 may then be reversed to disengage the catch 112 from the lip 104, and thereby enable separation of the respective sections of the assembly 100.

Figure 5:
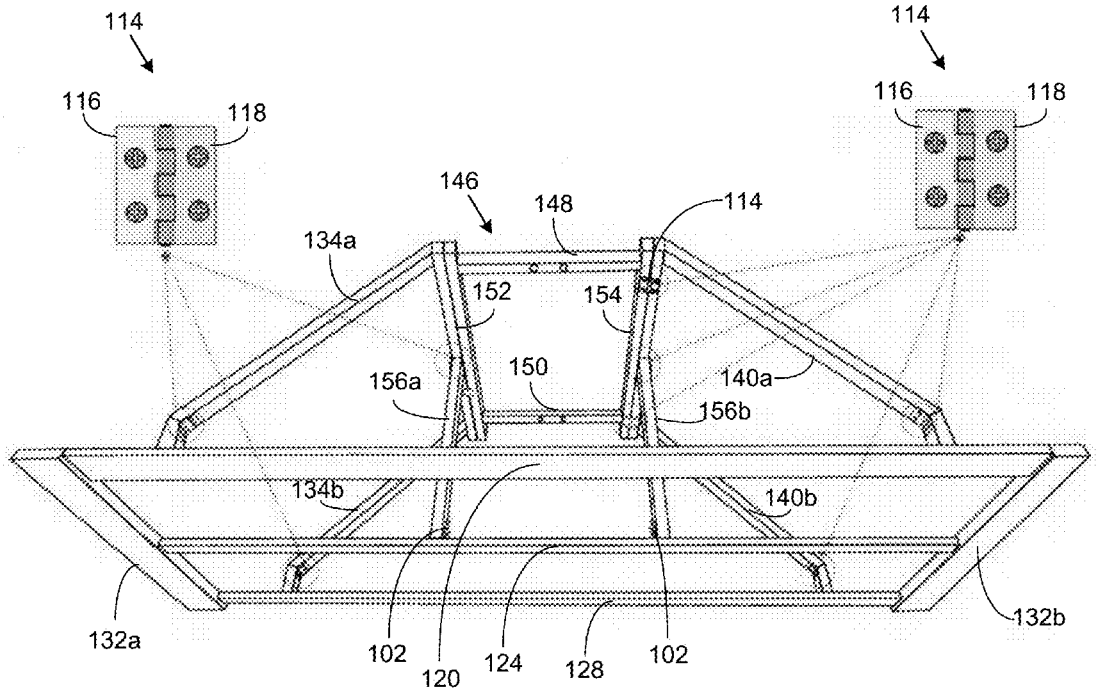
FIG. 5 illustrates perspective view of the collapsible television support assembly with a blow up view of an exemplary simple hinge, in accordance with an embodiment of the present invention.
Figure 6:
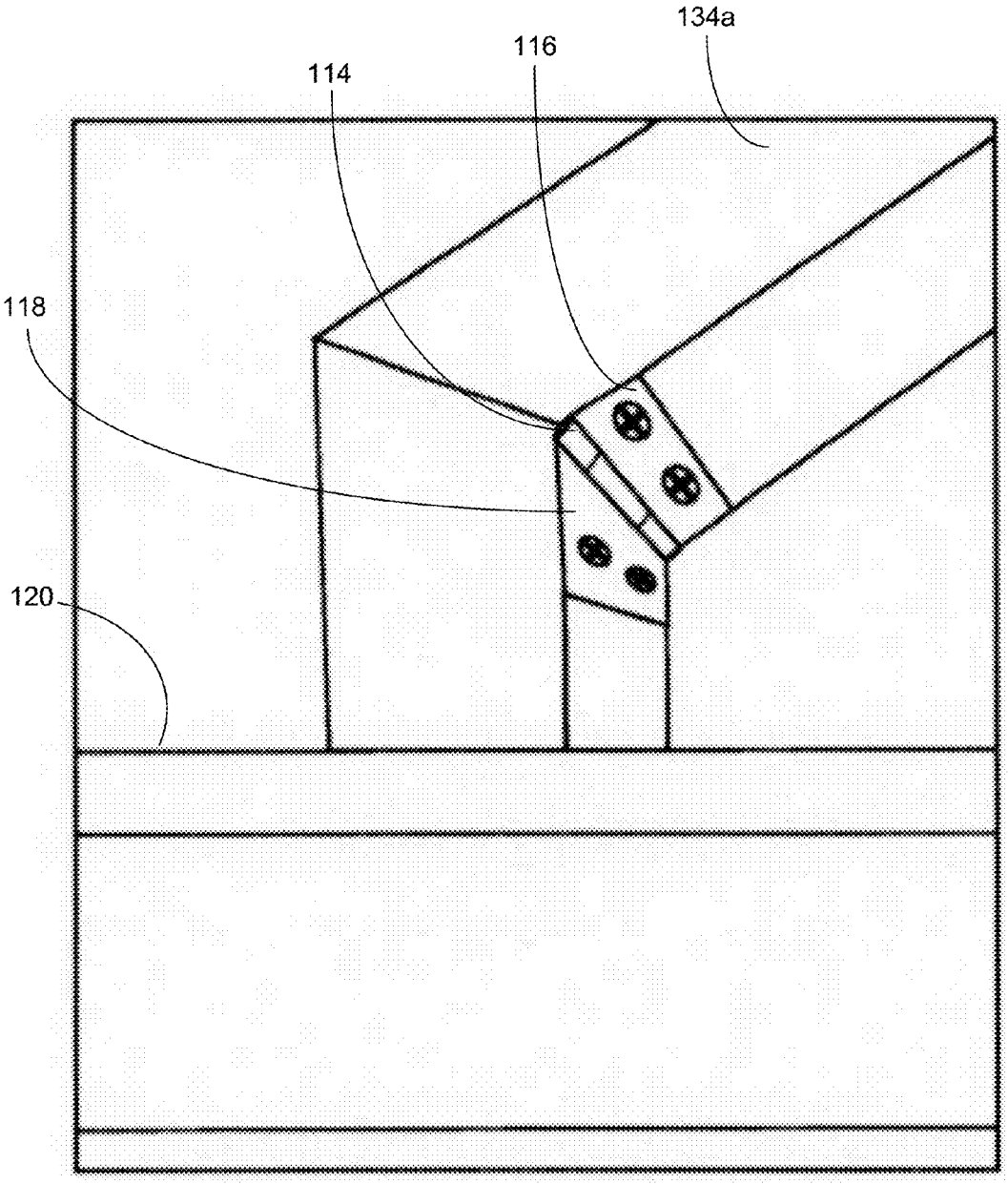
FIG. 6 illustrates a close-up view of the simple hinge at the first front end of the first connecter bar, in accordance with an embodiment of the present invention.

Turning now to FIG. 5, the assembly 100 also utilizes at least one simple hinge 114 to enable hinged connections between sections of the assembly 100. However, unlike the separable buckle hinge 102, the simple hinge 114 does not separate. The simple hinge 114 comprises a first hinge side 116 that pivotally joins a second hinge side 118 (FIG. 6). In one embodiment, the simple hinge 114 pivots up to 90°.

Looking back at FIGS. 2A and 2B, the assembly 100 comprises an upper arm 120, a middle arm 124, and a lower arm 128. The arms 120, 124, 128 are generally parallel and spaced-apart. The upper arm 120 is defined by a pair of upper ends. The assembly 100 further includes a middle arm 124. The middle arm 124 is defined by a pair of middle ends. The assembly 100 further includes a lower arm 128. The lower arm 128 is defined by a pair of lower ends.

The upper arm 120, the middle arm 124, and the lower arm 128 are disposed in a generally horizontal, spaced-apart relationship. In some embodiments, the assembly 100 may include a pair of legs 132*a-b*. Each leg 132*a-b* attaches in a generally perpendicular disposition to a respective end of the upper arm 120, the middle arm 124, and the lower arm 128. Thus, the arms 120, 124, 128 and the pair of legs 132*a-b* join to form a generally rectangular shape, at the front of the assembly 100.

In some embodiments, the assembly 100 may include a pair of first connecting bars 134*a-b*. The pair of first connecting bars 134*a-b* are disposed in a generally parallel, spaced apart relationship. The pair of first connecting bars 134*a-b* are defined by a first front end 136*a-b* and a first rear end 138*a-b*. The first front end 136*a-b* is pivotally carried by the upper arm 120 and the lower arm 128. The pair of first connecting bars 134*a-b* are coupled to the upper arm 120 and the lower arm 128 about the simple hinge 114.

In some embodiments, the assembly 100 may include a pair of second connecting bars 140*a-b*. The pair of second connecting bars 140*a-b* are disposed in a generally parallel, spaced apart relationship. The pair of second connecting bars 140*a-b* are defined by a second front end 142*a-b* and a second rear end 144*a-b*. The second front end 142*a-b* is pivotally carried by the upper arm 120 and the lower arm 128. The pair of second connecting bars 140*a-b* are coupled to the upper arm 120 and the lower arm 128 about the simple hinge 114. In one embodiment, the pair of first connecting bars 134*a-b* and the pair of second connecting bars 140*a-b* extend at an outward angle from the frame 146 to the upper arm 120 and the lower arm 128, respectively.

Figure 7:
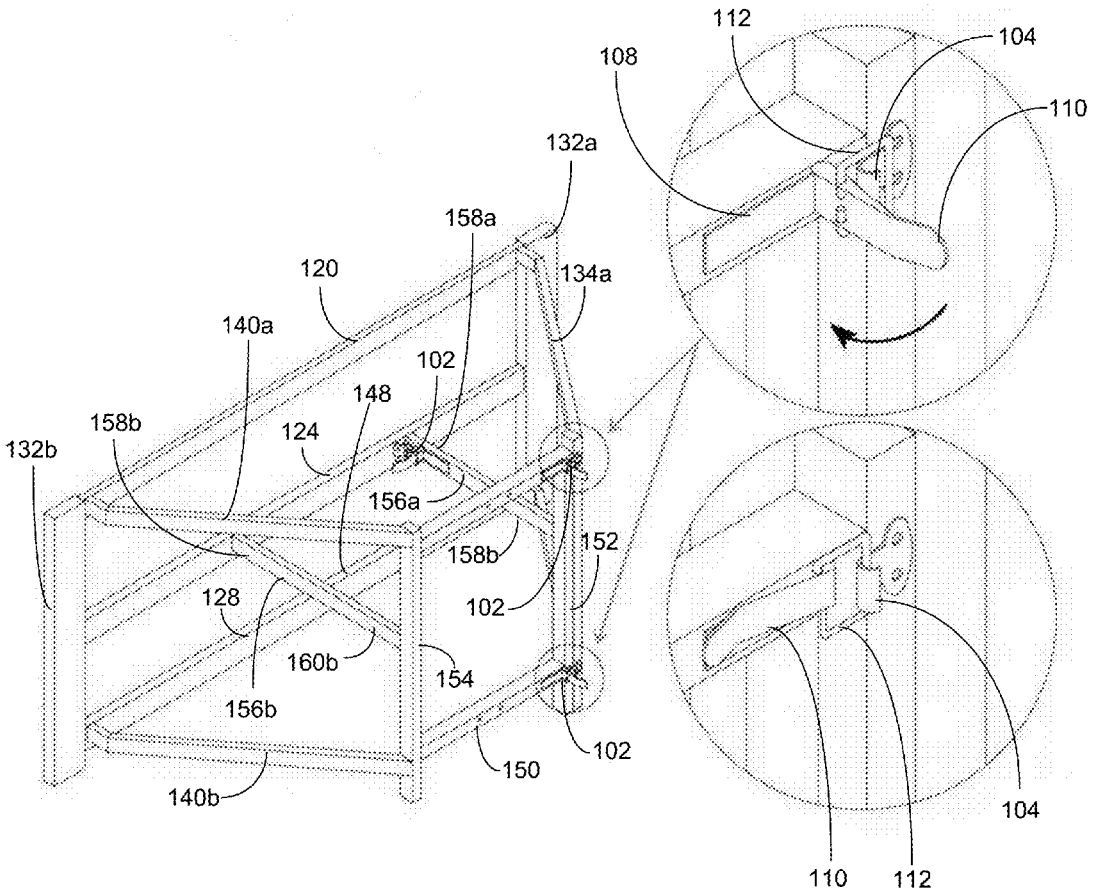
FIG. 7 illustrates a close-up view of the separable buckle hinge between the first frame end and the pair of first connecting bars, in accordance with an embodiment of the present invention.
Figure 8:
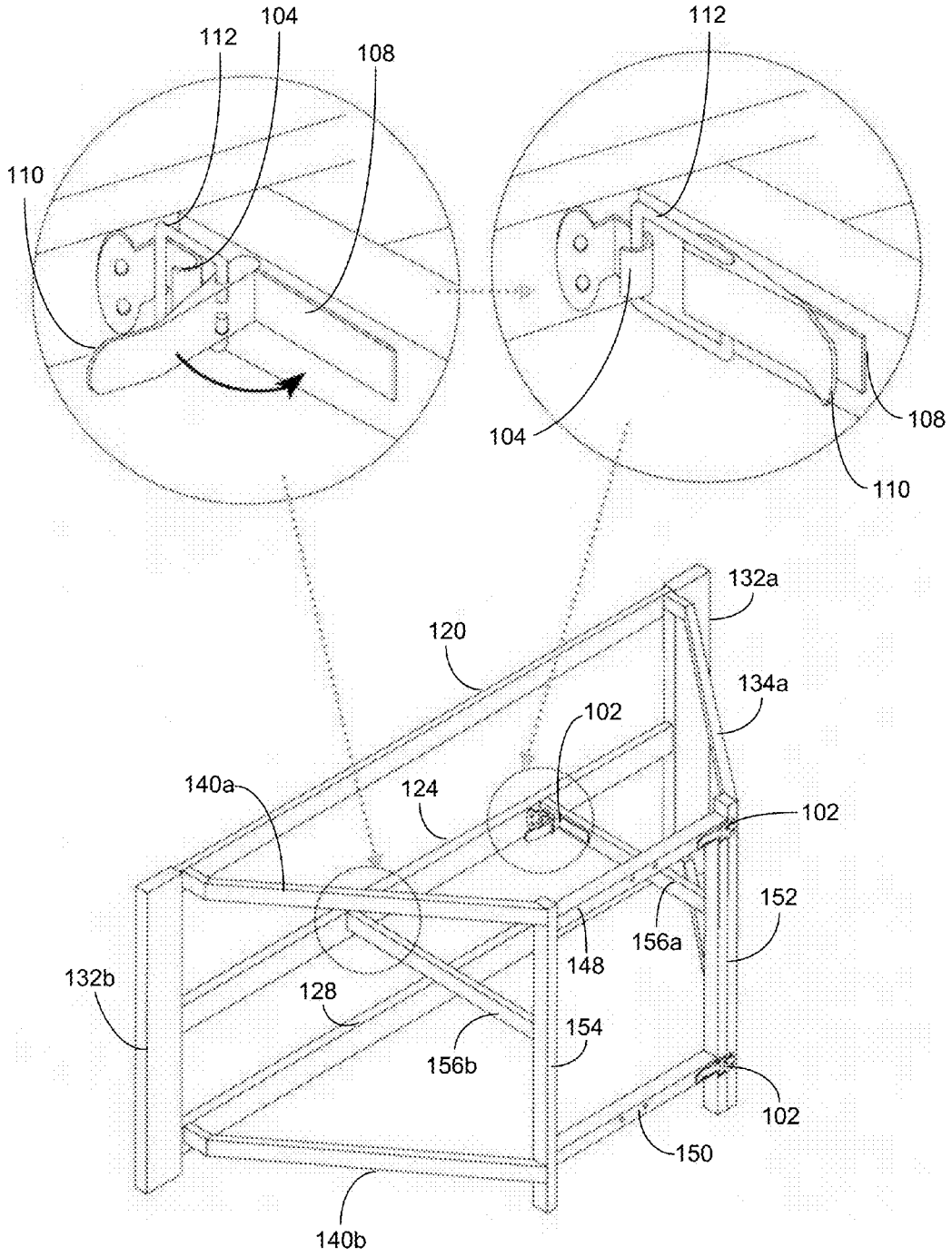
FIG. 8 illustrates a close-up view of the separable buckle hinge between the front shaft end and the middle arm, in accordance with an embodiment of the present invention.

In some embodiments, the frame 146 has a generally rectangular shape. The frame 146 is defined by an upper frame end 148, a lower frame end 150, a first frame end 152, and a second frame end 154. Each end 148, 150, 152, 154 joins together to form the substantially rectangular shape. The first frame end 152 is pivotally carried by the pair of first connecting bars 134*a-b* about the separable buckle hinge 102, as shown in FIGS. 7 and 8.

In this manner, the frame 146 may pivot up to 90°, and separate from the first connecting bars 134*a-b* while moving to the collapsed position. The second frame end 154 is pivotally carried by the pair of second connecting bars 140*a-b* about the simple hinge 114. In this manner, the frame 146 may pivot up to 90°, yet separation between the second frame end 154 and the second connecting bars 140*a-b* is not possible with the simple hinge 114.

The separable buckle hinge 102 and the simple hinge 114 enable the arms 120, 124, 128, legs 132*a-b*, and connecting bars 134*a-b*, 140*a-b* to hingedly collapse and expand. The separable buckle hinge 102 further enables separation of the respective arms 120, 124, 128, legs 132*a-b*, connecting bars 134*a-b*, 140*a-b*, and frame ends 148, 150, 152, 154.

Figure 9A:
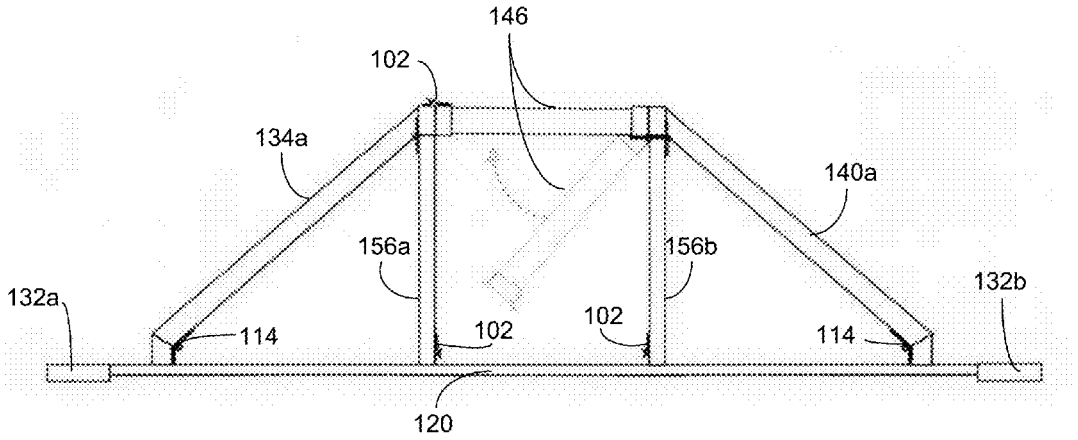
FIGS. 9A, 9B, 9C, and 9D illustrate top view of the collapsible television support assembly moving between an expanded position to a collapsed position, where

In one exemplary configuration illustrated in FIG. 9A, the pair of first connecting bars 134*a-b* are disposed to extend at an angle between a first leg 132*a* and the first frame end 152 while in an expanded position. Conversely, the pair of first connecting bars 134*a-b* move coplanar to the upper arm 120, the middle arm 124, and the lower arm 128 in the collapsed position. This forms a substantially flat configuration that is efficacious for stowage and portability of the assembly 100.

In another exemplary configuration, the pair of second connecting bars 140*a-b* are disposed to extend at an angle between a second leg 132*b* and the second frame end 154 while in an expanded position. Conversely, the pair of second connecting bars 140*a-b* move coplanar to the upper arm 120, the middle arm 124, and the lower arm 128 while in the collapsed position. This forms a substantially flat configuration that is efficacious for stowage and portability of the assembly 100.

Figure 9B:
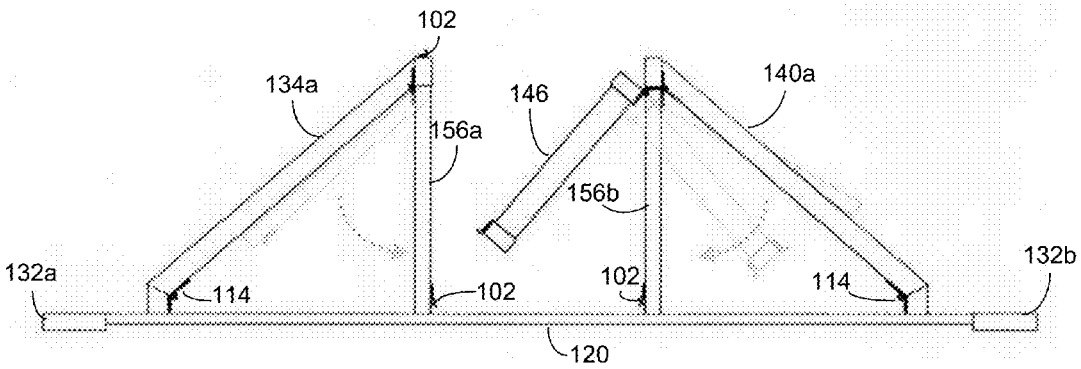

In another exemplary configuration, the frame 146 is disposed in a coplanar, spaced-apart relationship with the upper arm 120, the middle arm 124, and the lower arm 128 while in the expanded position. FIG. 9B shows the frame 146 pivoting inwardly towards the first connecting bars 134*a-b*. Conversely, the frame 146 is disposed between the pair of first connecting bars 134*a-b* and the upper arm 120, the middle arm 124, and the lower arm 128 while in the collapsed position. This forms a substantially flat configuration that is efficacious for stowage and portability of the assembly 100.

The assembly 100 may further include a pair of support shafts 156*a-b* that extend transversely form a front region to a rear region of the assembly 100. The support shafts 156*a-b* provide lateral stability to the assembly 100. The capacity to provide lateral stability is especially significant since the assembly 100 supports generally heavy televisions and entertainment devices. The pair of support shafts 156*a-b* are defined by a front shaft end 158*a-b* and a rear shaft end 160*a-b*.

As shown in FIG. 3, the support shafts 156*a-b* are pivotally carried by the middle arm 124. The front shaft end 158*a-b* is coupled to the middle arm 124 about the separable buckle hinge 102. In other embodiments, the pair of support shafts 156*a-b* are also pivotally carried by the first frame end 152 and the second frame end 154. The rear shaft end 160*a-b* couples to the first frame end 152 and the second frame end 154 about the simple hinge 114.

Figure 9C:
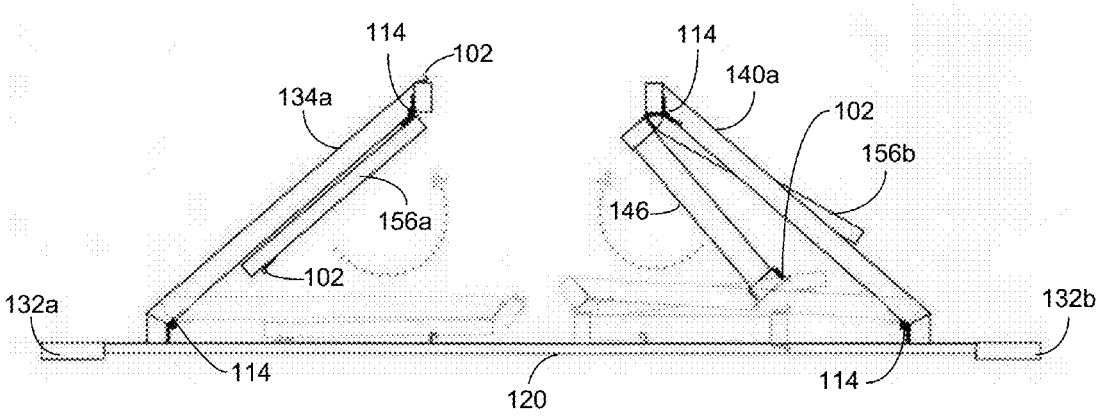
Figure 9D:
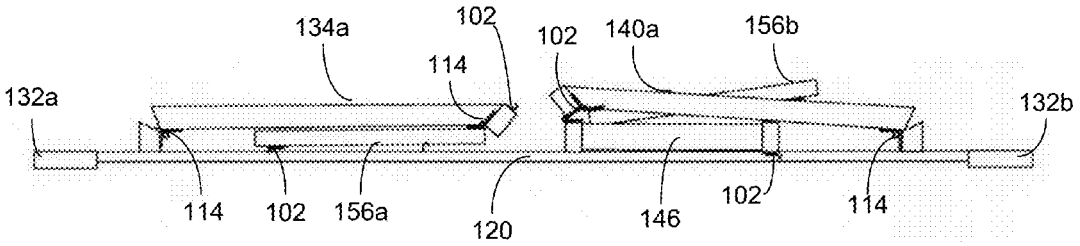

In some embodiments, the pair of support shafts 156*a-b* extend between the middle arm 124 and the frame 146 while in the expanded position. This transverse crossing of the support shafts 156*a-b* occupies a space in the central region of the assembly 100, which restricts undesirable torqueing, bending, and warping of the arms 120, 124, 128, legs 132*a-b*, connecting bars 134*a-b*, 140*a-b*, and frame ends 148, 150, 152, 154 that make up the assembly 100. However, as shown in FIG. 9C, the pair of support shafts 156*a-b* pivot towards the arms 120, 124, 128 and are pressed coplanar with the arms 120, 124, 128 in the collapsed position. The fully collapsed position of the assembly 100 is illustrated in FIG. 9D.

Thus, the assembly 100 is specially configured so that the arms 120, 124, 128, legs 132*a-b*, connecting bars 134*a-b*, and frame ends 148, 150, 152, 154 are hingedly and detachably connected together so that they may be quickly assembled and also disassembled and returned to the collapsed position for further storage or shipment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A collapsible television support assembly for facilitated folding and enhanced lateral stability, the assembly comprising:

at least one separable buckle hinge, the at least one separable buckle hinge configured to enable hinged and detachable connections, the at least one separable buckle hinge defined by a lip and a latching member, the latching member having a mounting panel, a lever, and a catch, the lever configured to pivotally engage the catch to the lip, wherein the lip and the latching member detachably fasten;

at least one simple hinge, the at least one simple hinge configured to enable hinged connections, the at least one simple hinge defined by a first hinge side configured to pivotally join with a second hinge side;

an upper arm, the upper arm defined by a pair of upper ends;

a middle arm, the middle arm defined by a pair of middle ends;

a lower arm, the lower arm defined by a pair of lower ends, wherein the upper arm, the middle arm, and the lower arm are disposed in a generally horizontal, spaced-apart relationship;

a pair of legs, each leg attached in a generally perpendicular disposition to a respective end of the upper arm, the middle arm, and the lower arm;

a pair of first connecting bars, the pair of first connecting bars disposed in a generally parallel, spaced apart relationship, the pair of first connecting bars defined by a first front end and a first rear end, the first front end pivotally carried by the upper arm and the lower arm, the pair of first connecting bars coupled to the upper arm and the lower arm about the at least one simple hinge;

a pair of second connecting bars, the pair of second connecting bars disposed in a generally parallel, spaced apart relationship, the pair of second connecting bars defined by a second front end and a second rear end, the second front end pivotally carried by the upper arm and the lower arm, the pair of second connecting bars coupled to the upper arm and the lower arm about the at least one simple hinge;

a generally rectangular frame, the frame defined by an upper frame end, a lower frame end, a first frame end, and a second frame end, the first frame end pivotally carried by the pair of first connecting bars, the first frame end coupled to the pair of first connecting bars about the at least one separable buckle hinge, the second frame end pivotally carried by the pair of second connecting bars, the second frame end coupled to the pair of second connecting bars about the at least one simple hinge;

wherein the pair of first connecting bars are disposed to extend at an angle between the first leg and the first frame end while in an expanded position;

wherein the pair of first connecting bars are disposed coplanar to the upper arm, the middle arm, and the lower arm while in a collapsed position;

wherein the pair of second connecting bars are disposed to extend at an angle between the second leg and the second frame end while in an expanded position;

wherein the pair of second connecting bars are disposed coplanar to the upper arm, the middle arm, and the lower arm while in a collapsed position;

wherein the frame is disposed in a coplanar, spaced-apart relationship with the upper arm, the middle arm, and the lower arm while in the expanded position;

wherein the frame is disposed between the pair of first connecting bars and the upper arm, the middle arm, and the lower arm while in the collapsed position;

a pair of support shafts, the pair of support shafts defined by a front shaft end and a rear shaft end, the pair of support shafts pivotally carried by the middle arm, the front shaft end coupled to the middle arm about the at least one separable buckle hinge, the pair of support shafts further pivotally carried by the first frame end and the second frame end, the rear shaft end coupled to the first frame end and the second frame end about the at least one simple hinge;

wherein the pair of support shafts extend between the middle arm and the frame while in the expanded position;

wherein the pair of support shafts are configured to enhance lateral stability of the assembly while in the expanded position; and wherein the pair of support shafts are generally coplanar with the upper arm, the middle arm, and the lower arm while in the collapsed position.

2. The assembly of claim 1, wherein the assembly is a television table.

3. The assembly of claim 1, wherein the assembly further comprises an upper shelf, a middle shelf, and a lower shelf.

4. The assembly of claim 1, wherein the at least one separable buckle hinge enables pivoting up to ninety degrees.

5. The assembly of claim 1, wherein the at least one separable buckle hinge comprises four separable buckle hinges.

6. The assembly of claim 1, wherein the lip of the at least one separable hinge enables passage of a screw for fastening the lip to the assembly.

7. The assembly of claim 1, wherein the mounting panel of the latching member enables passage of a screw for fastening the mounting panel to the assembly.

8. The assembly of claim 1, wherein the lever of the latching member pivots on a fulcrum.

9. The assembly of claim 1, wherein the catch is generally square-shaped.

10. The assembly of claim 1, wherein the at least one simple hinge enables pivoting up to ninety degrees.

11. The assembly of claim 1, wherein the at least one simple hinge comprises eight simple hinges.

12. The assembly of claim 1, wherein the upper arm, the middle arm, and the lower arm are generally flat and elongated.

13. The assembly of claim 1, wherein the upper arm, the middle arm, and the lower arm are horizontally disposed.

14. The assembly of claim 1, wherein the pair of legs are vertically disposed.

15. The assembly of claim 1, wherein the pair of first connecting bars and the pair of second connecting bars extend at an outward angle from the frame to the upper arm and the lower arm.

16. The assembly of claim 1, wherein the first frame end detaches from the pair of first connecting bars through the at least one separable buckle hinge while in the collapsed position.

17. The assembly of claim 1, further including a vertical bracket, the vertical bracket configured to support a television.

18. The assembly of claim 17, wherein the vertical bracket attaches to the frame.

19. A collapsible television support assembly for facilitated folding and enhanced lateral stability, the assembly comprising:

at least one separable buckle hinge, the at least one separable buckle hinge configured to enable hinged and detachable connections;

at least one simple hinge, the at least one simple hinge configured to enable hinged connections;

an upper arm, the upper arm defined by a pair of upper ends;

a middle arm, the middle arm defined by a pair of middle ends;

a lower arm, the lower arm defined by a pair of lower ends, wherein the upper arm, the middle arm, and the lower arm are disposed in a generally horizontal, spaced-apart relationship;

a pair of legs, each leg attached in a generally perpendicular disposition to a respective end of the upper arm, the middle arm, and the lower arm;

a pair of first connecting bars, the pair of first connecting bars disposed in a generally parallel, spaced apart relationship, the pair of first connecting bars defined by a first front end and a first rear end, the first front end pivotally carried by the upper arm and the lower arm, the pair of first connecting bars coupled to the upper arm and the lower arm about the at least one simple hinge;

a pair of second connecting bars, the pair of second connecting bars disposed in a generally parallel, spaced apart relationship, the pair of second connecting bars defined by a second front end and a second rear end, the second front end pivotally carried by the upper arm and the lower arm, the pair of second connecting bars coupled to the upper arm and the lower arm about the at least one simple hinge;

a generally rectangular frame, the frame defined by an upper frame end, a lower frame end, a first frame end, and a second frame end, the first frame end pivotally carried by the pair of first connecting bars, the first frame end coupled to the pair of first connecting bars about the at least one separable buckle hinge, the second frame end pivotally carried by the pair of second connecting bars, the second frame end coupled to the pair of second connecting bars about the at least one simple hinge;

wherein the pair of first connecting bars are disposed to extend at an angle between the first leg and the first frame end while in an expanded position;

wherein the pair of first connecting bars are disposed coplanar to the upper arm, the middle arm, and the lower arm while in a collapsed position;

wherein the pair of second connecting bars are disposed to extend at an angle between the second leg and the second frame end while in an expanded position;

wherein the pair of second connecting bars are disposed coplanar to the upper arm, the middle arm, and the lower arm while in a collapsed position;

wherein the frame is disposed in a coplanar, spaced-apart relationship with the upper arm, the middle arm, and the lower arm while in the expanded position;

wherein the frame is disposed between the pair of first connecting bars and the upper arm, the middle arm, and the lower arm while in the collapsed position;

a pair of support shafts, the pair of support shafts defined by a front shaft end and a rear shaft end, the pair of support shafts pivotally carried by the middle arm, the front shaft end coupled to the middle arm about the at least one separable buckle hinge, the pair of support shafts further pivotally carried by the first frame end and the second frame end, the rear shaft end coupled to the first frame end and the second frame end about the at least one simple hinge;

wherein the pair of support shafts extend between the middle arm and the frame while in the expanded position;

wherein the pair of support shafts are configured to enhance lateral stability of the assembly while in the expanded position; and wherein the pair of support shafts are generally coplanar with the upper arm, the middle arm, and the lower arm while in the collapsed position.

20. The assembly of claim 19, further including a vertical bracket, the vertical bracket configured to support a television.

* * * * *